US005280919A

United States Patent [19]

Graham

[11] Patent Number: 5,280,919

[45] Date of Patent: Jan. 25, 1994

[54] PORTABLE TARGET ASSEMBLY

[76] Inventor: Richard D. Graham, 73 N. 300 East, Emery, Utah 84522

[21] Appl. No.: 973,778

[22] Filed: Nov. 9, 1992

[51] Int. Cl.[5] ..... F41J 1/10; F41J 5/06; F41J 5/24

[52] U.S. Cl. ..... 273/381; 273/407

[58] Field of Search ..... 273/381, 382, 398, 400, 273/401, 407

[56] References Cited

U.S. PATENT DOCUMENTS

| | | | |
|---|---|---|---|
| 437,267 | 9/1890 | Walker | 273/407 X |
| 2,899,204 | 8/1959 | Ratay | 273/407 X |
| 3,647,214 | 3/1972 | Hohmann | 273/407 X |
| 4,029,318 | 6/1977 | Boss | 273/407 X |
| 4,786,058 | 11/1988 | Baughman | 273/371 |
| 4,828,269 | 5/1989 | Tessel | 273/373 |
| 4,869,513 | 9/1989 | Auer et al. | 273/315 |

*Primary Examiner*—William H. Grieb
*Attorney, Agent, or Firm*—S. Michael Bender

[57] ABSTRACT

A portable target assembly is provided for use with airguns of the pellet or ball (BB) variety. The target assembly includes a rectangular frame which is supported by two leg members which are pivotally mounted on the right and left side of the frame. A canvas element is secured about the exterior of the frame and the leg members which forms a trap for the spent pellets or balls. Several rows of targets depend from struts which are mounted on the interior of the rectangular frame. The targets are suspended by cord elements which are secured to the strut by a locking member. By adjusting the length of the cord the target height may be altered. The targets are a variety of geometric shapes. The center of the target is hollowed out so that a loud report is sounded when the target is hit by a projectile.

12 Claims, 4 Drawing Sheets

PORTABLE TARGET ASSEMBLY

BACKGROUND OF THE INVENTION

1. Field of the Invention

The present invention relates generally to a target assembly, and more particularly, to a target assembly which is both portable and collapsible, especially adapted to effect and contribute to the safe use of airguns of the pellet and ball (BB) variety.

2. Description of the Prior Art

Practice target devices which indicate a projectile impact are known in the art. The most common target of this nature would be the bottle or can which is erected at a reasonable distance from the shooter. When hit, the target falls down indicating a hit. The combination of a target falling when hit by a projectile with the target mounted in an assembly is also known (U.S. Pat. No. 4,869,513). Also known are targets which indicate a hit by an electrical signal being generated (U.S. Pat. No. 4,828,269). Another known device includes a suspended target which indicates the location of the impact by the generation of a variable electrical signal that when processed indicates which sector of the target has been hit (U.S. Pat. No. 4,786,058). None of the prior arrangements, however, contemplate a portable target assembly which designates a projectile hit by a report from the target. Also, it is not shown that the targets have an adjustable height. Nor do any of the devices of the prior art show a collapsible, portable assembly with a canvas backdrop which permits the target assembly to be used safely in many different locations such as a basement or backyard as does the present invention. The instant invention is not only cost effective, of simple construction, easy to set up, utilize and store, but furthermore includes means for indicating a hit and adjusting the height of its targets. Other advantages of the present invention over the prior art also will be rendered evident.

SUMMARY OF THE INVENTION

To achieve the foregoing and other advantages, the present invention, briefly described, provides a portable target assembly for use with airguns of the pellet or ball (BB) variety. The target assembly includes a rectangular frame which is supported by two leg members which are pivotally mounted on the right and left side of the frame. A canvas element is secured about the exterior of the frame and the leg members which forms a trap for the spent pellets or balls. Several rows of targets depend from struts which are mounted on the interior of the rectangular frame. The targets are suspended by cord elements which are secured to the strut by a locking member. By adjusting the length of the cord the target height may be altered. The targets are a variety of geometric shapes. The center of the target is hollowed out so that a large report is sounded when the target is hit by a receptacle.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it should be understood that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved portable target assembly which has all of the advantages of the prior art and none of the disadvantages.

It is another object of the present invention to provide a new an improved portable target assembly which may be easily and efficiently manufactured and marketed.

It is a further objective of the present invention to provide a new and improved portable target assembly which is of durable and reliable construction.

An even further object of the present invention is to provide a new and improved portable target assembly which is susceptible of a low cost of manufacture with regard to both materials and labor, and which accordingly is then susceptible of low prices of sale to the consuming public, thereby making such a portable target assembly available to the buying public.

Still yet a further object of the present invention is to provide a new and improved portable target assembly which is collapsible for easy storage.

It is still a further object of the present invention is to provide a new and improved portable target assembly which has a variety of geometrically shaped targets which may be altered in position.

Still a further object of the present invention is to provide a new and improved portable target assembly which indicates a projectile impact by an audio signal which is enhanced due to the target structure.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved portable target assembly embodying the principles and concepts of the present invention will be described.

Figure 1:
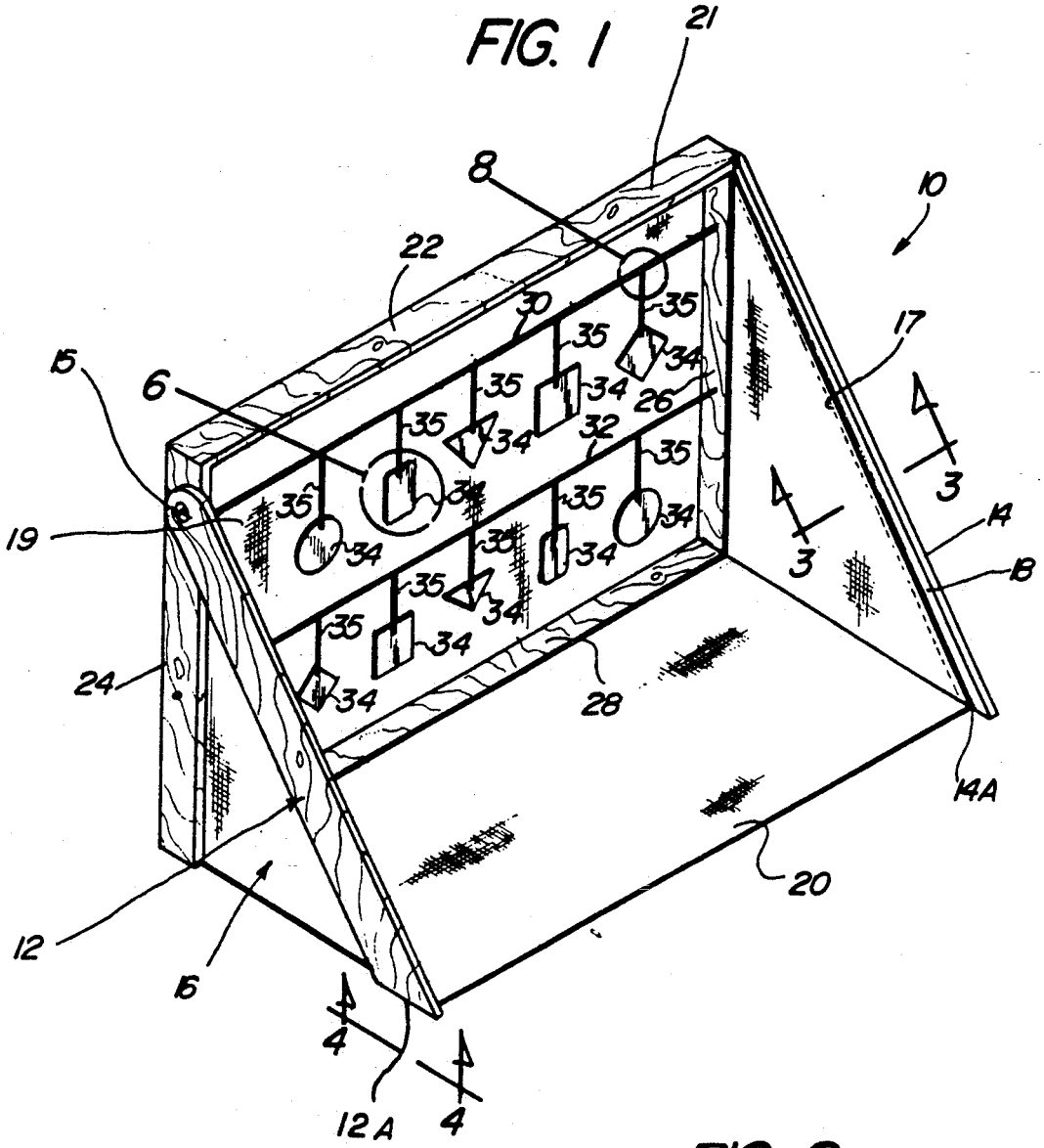
FIG. 1 is a perspective view showing the preferred embodiment of the portable target assembly of the invention.

Referring now to FIG. 1, the target assembly 10 comprises a generally rectangular frame 21 supported by a right leg element 14 and a left leg element 14. An upper strut 30 and a lower strut 32 are mounted inside the frame 21 between right frame member 24 and left frame member 26. A plurality of targets 34 depend from the upper strut 30 and lower strut 32 by a plurality of target support cords 35.

A rear canvas element 19 is secured to the rear of the frame 21 forming a backdrop behind the targets 34. A right canvas element 18 is secured between the right leg element 14 and the right frame member 24. A left canvas element 16 is secured between the left leg element 12 and the left frame member 26. A bottom canvas element 20 is secured to the lower frame member 28 and the foot of the right leg element 14A and the foot of the left leg element 12A. The frame, legs, and canvas elements form a generally triangular walled structure with the targets 34 inside the structure. This canvas structure which surrounds the frame and legs acts to trap the BB's fired thus preventing harmful and damaging rebounds or misses. Of course, materials similar to but other than canvas may be used instead such as, for example, a double-knit fabric or other woven or non-woven fabric.

Figure 2:
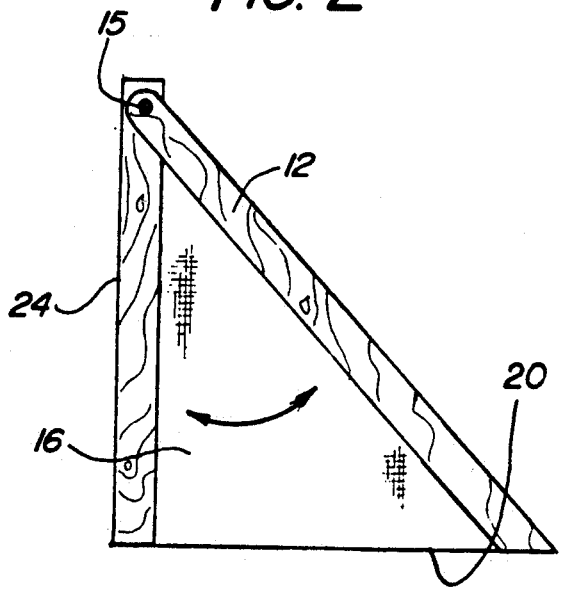
FIG. 2 is a side view of the portable target assembly.

The portable target assembly 10 is collapsible. The right leg element 14 and left leg element 12 are pivotally attached to the right frame member 24 and the left frame member 26 respectively by a pivot element 15. Referring now to FIG. 2, left leg element 12 is shown rotated about pivot member 15. Bottom canvas element 20 would form a pocket when the portable target assembly 10 is in the collapsed position. This pocket may be used for storage of recycled BB's.

Figure 3:
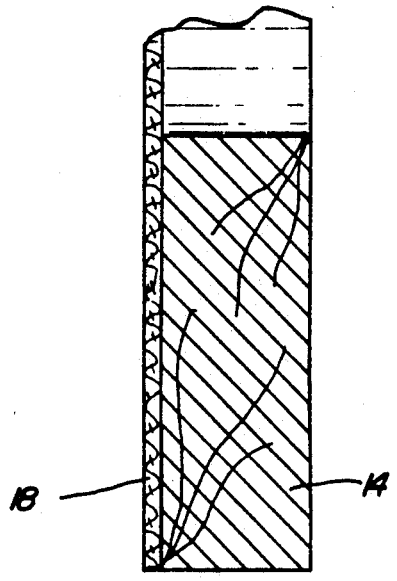
FIG. 3 is a cross-sectional view of the portable target assembly of FIG. 1 taken along line 3—3 thereof.

FIG. 3 show the right canvas element 18 connected to the right leg element 14. The canvas members may be attached to the leg elements and the frame members by any of a variety of connection means 17, including, but not limited to, staples, glue, or nails. The connection means 17 firmly attaches the canvas members to the leg elements and frame members.

Figure 4:
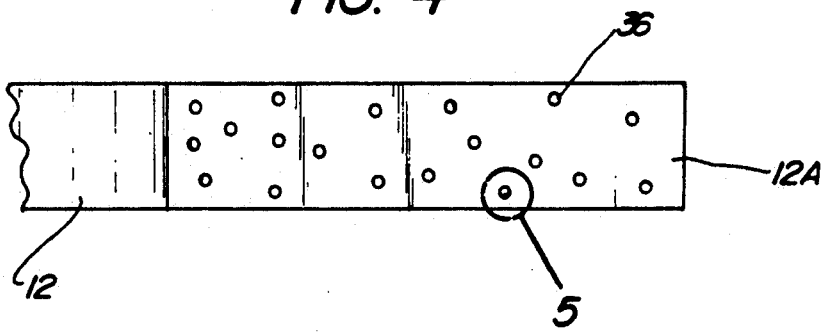
FIG. 4 is a cross-sectional view of the portable target assembly of FIG. 1 taken along line 4—4 thereof.
Figure 5:
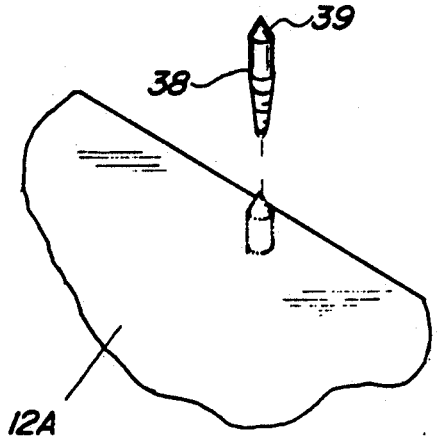
FIG. 5 is a partial view of the portable target assembly showing means to secure the assembly in position.

The portable target assembly 10 may be erected in any of a variety of locations. Means are provided in order to firmly secure the portable target assembly 10 to the desired location. These securing means are shown in FIGS. 4 and 5. The foot of the right leg element 14A and the foot of the left leg element 12A are provided with a plurality of apertures 36. Teeth 38 are provided which may be screwed into the apertures 36 leaving a pointed projection 39 exposed. The pointed projection 39 are then pushed into the ground which stabilizes and secures the portable target assembly 10 in place.

Figure 6:
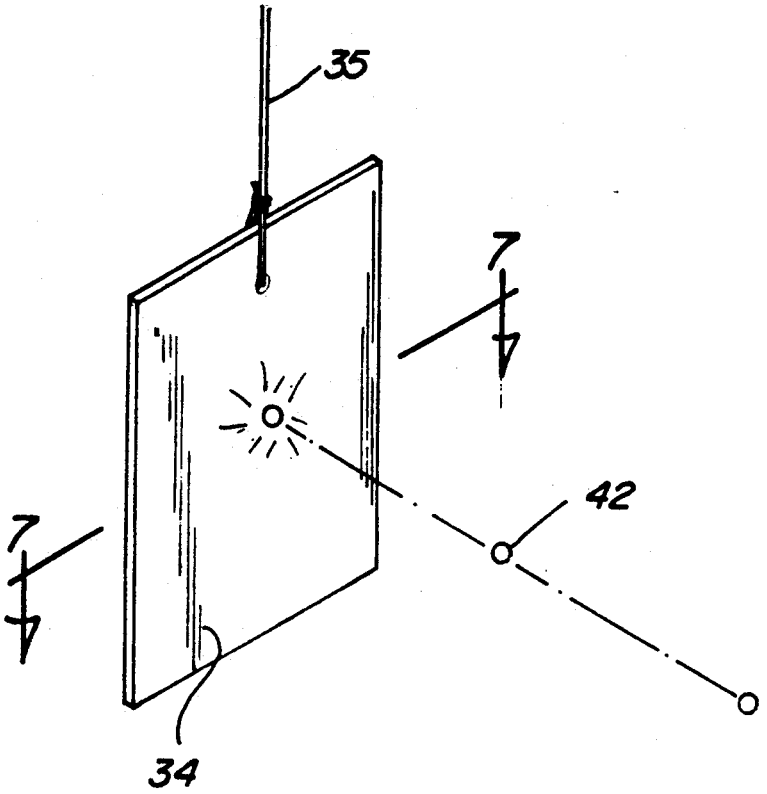
FIG. 6 is partial view of the portable target assembly showing a target being hit by a projectile.
Figure 7:
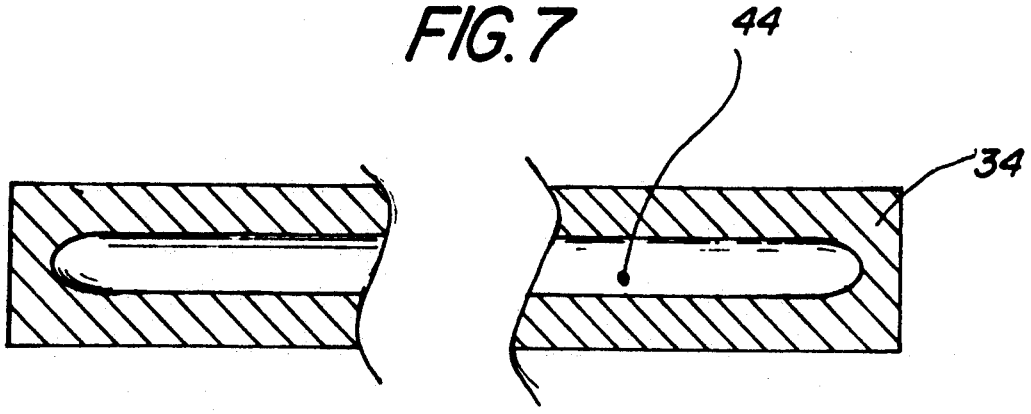
FIG. 7 is a cross-sectional view of FIG. 6 taken along line 7—7 showing the hollow interior of the target.

The targets 34 are a variety of geometrical shapes. They may be circular, rectangular, triangular or square. Other geometrical forms may be used as targets as well. FIGS. 6 and 7 shows a generic target 34 utilized by the portable target assembly 10. A BB 42 strikes the target 34 causing a report. The targets 34 are provided with a hollow center 44. This hollow center 44 causes the report to be louder which permits the shooter to recognize a hit on the target 34.

Figure 8:
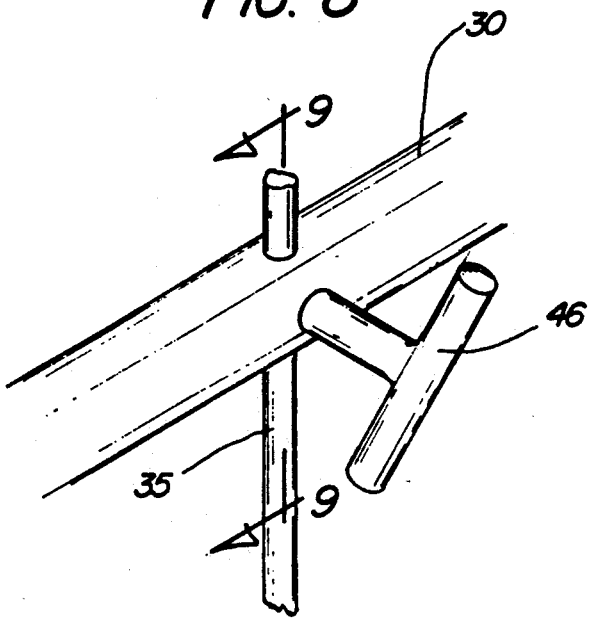
FIG. 8 is a partial view of the portable target assembly showing the target cord securing means.
Figure 9:
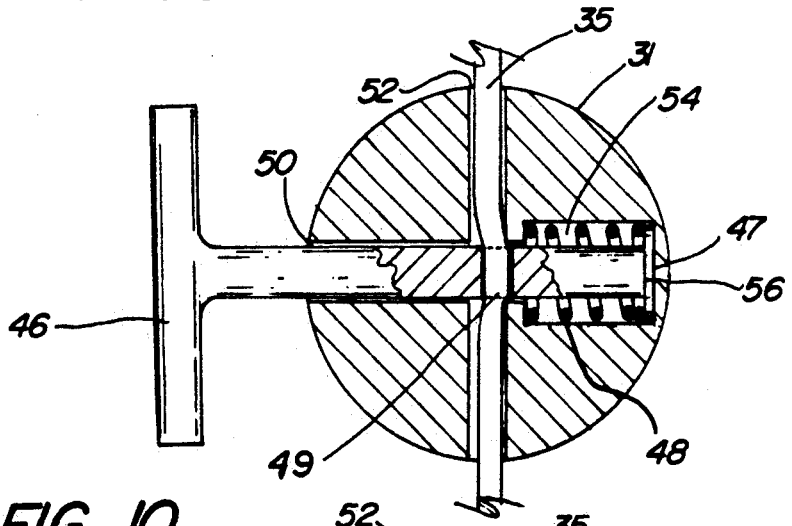
FIG. 9 is a cross-sectional view of FIG. 8 taken along line 9—9 showing the target cord securing means in the locked position.
Figure 10:
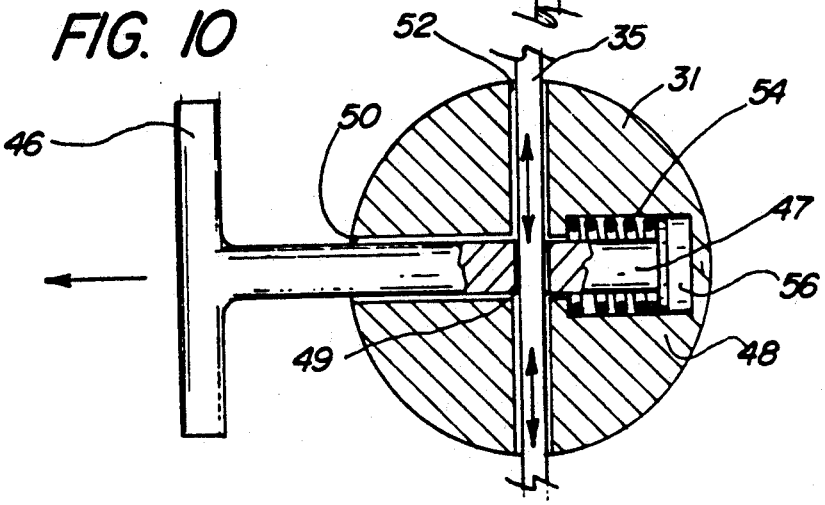
FIG. 10 is a cross-sectional view of FIG. 8 taken along line 9—9 showing the target cord securing means in the unlocked position.

The targets 34 may have their position changed up and down by adjusting the target support cord 35. FIGS. 8-10 demonstrates the structure which permits the adjustment of the target height. As shown in FIG. 8, target support cord 35 passes through upper strut 30 and is held in place by a handle 46. The lower strut 32 is provided with this same structure. Referring now to FIGS. 9 and 10 the generic cross-section of strut 31 is shown. Strut 31 may represent either the upper strut 30 or the lower strut 32 as both structures are identical. A support cord bore 52 is provided vertically through the strut 31. A handle bore 50 is provided horizontally through the strut 31. The handle bore 50 intersects a larger diameter bore 54. A spring 48 is nested in the bore 54. The handle 46 has a shaft 47 which extends from the center of the handle giving a T-shaped appearance. The handle bore 50 and the support cord bore 52 are perpendicular to each other and intersect in the center of the strut 31. The shaft 47 is provided with a shaft bore 49. The target support cord 35 passes through the support cord bore 52 and the shaft bore 49. Shaft 47 is connected to the spring 48. By pulling out the handle 46, the support cord bore 52 and the shaft bore 49 become coincident. The target support cord 35 may be moved up or down at this point adjusting the height of the target 34. By releasing the handle 46, the shaft 47 is pulled to the right by the spring 48 causing the target support cord 35 to be secured inside the strut 31 against the wall of the support cord bore 52. FIG. 9 shows the handle 46 in the locked position with the spring 48. The spring 48 is extended against the shaft end plate 56. FIG. 10 shows the handle 46 in the unlocked position, permitting the target support cord 35 to move freely up and down. Spring 48 is compressed by the shaft end plate 56. When pressure is released from the handle 46, the spring force pushes against the shaft end plate 54, pulling the shaft 47 and handle 46 inward into the strut 31, thus securing the target support cord 35 in position.

Alternatively, target supports 35 may take the form of a cylindrical rod having an end bent back upon itself to form a hook. The hook may then be used to suspend the targets from struts 30, 32. With this arrangement when a target is struck by a pellet it will spin around the strut. The cylindrical support rods also may be of varying length to present targets of differing height.

It is apparent from the above that the present invention accomplishes all of the objectives set forth by providing a new and improved portable target assembly which has a variety of geometrically shaped targets which may be altered in position, is collapsible and portable, has means for providing an enhanced auditory signal indicating a hit, and which is simple in construction and low in cost.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A new and improved portable target assembly for use with a conventional airgun comprising:

a rectangular frame, frame support means, target support means, and target means attached to said target support means whereby said assembly may be placed at any desired location and said targets may be fired upon by said conventional airgun, wherein said frame includes a right frame element, a left frame element, a lower frame element and an upper frame element, wherein said frame support means includes a right support member and a left support member, said right support member including a right upper section and a right lower section, and said left support member including a left upper section and a left lower section, wherein connection means secures said right support member, said right frame element and said left support member to said left frame element, and wherein said connection means includes a pivotable member which permits said right support member to pivot about said right frame element and said left support member to pivot about said left frame element.

2. The invention of claim 1 including a trap means, comprising a right wall, a left wall, a bottom floor, and a back wall.

3. The invention of claim 2 wherein said back wall is connected to said frame.

4. The invention of claim 3 wherein said right wall is connected to said right frame element and said right support member.

5. The invention of claim 4 wherein said left wall is connected to said left frame element and said left support member.

6. The invention of claim 5 wherein said bottom floor is connected to said lower frame element, said right lower section, said left lower section, said left wall and said right wall.

7. The invention of claim 6 wherein said trap means forms a housing about said frame, said frame support means and said target support means, said housing preventing a projectile from passing through said target assembly.

8. The invention of claim 7 wherein said targets are circular, triangular, square, and rectangular.

9. The invention of claim 8 wherein said targets are hollow.

10. The invention of claim 9 including target adjustment means located on said target support means.

11. The invention of claim 10 wherein said target adjustment means includes a spring biased handle whereby pulling said handle permits said target cord to be moved up and down relative to said target support means, and by letting go of said handle locks said target cord in place.

12. The invention of claim 11 wherein said target support means comprises several strut members.

* * * * *